US011732415B2

(12) United States Patent
Gomi

(10) Patent No.: US 11,732,415 B2
(45) Date of Patent: Aug. 22, 2023

(54) FIBER BODY FORMING APPARATUS AND CONTROL METHOD OF FIBER BODY FORMING APPARATUS

(71) Applicant: SEIKO EPSON CORPORATION, Tokyo (JP)

(72) Inventor: Katsuhito Gomi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/645,465

(22) Filed: Dec. 22, 2021

(65) Prior Publication Data

US 2022/0205181 A1 Jun. 30, 2022

(30) Foreign Application Priority Data

Dec. 24, 2020 (JP) ..... 2020-215839

(51) Int. Cl.

| | |
|---|---|
| ***D21F 9/00*** | (2006.01) |
| ***B27N 3/04*** | (2006.01) |
| ***D04H 1/60*** | (2006.01) |
| ***D04H 1/732*** | (2012.01) |
| ***D21G 9/00*** | (2006.01) |
| ***D21B 1/08*** | (2006.01) |

(52) U.S. Cl.

CPC ..... *D21F 9/00* (2013.01); *B27N 3/04* (2013.01); *D04H 1/60* (2013.01); *D04H 1/732* (2013.01); *D21G 9/0009* (2013.01); *D21B 1/08* (2013.01)

(58) Field of Classification Search

CPC ..... D21F 9/00; D21F 1/10; D21F 1/48; D21F 7/00; B27N 3/04; D04H 1/60; D04H 1/732; D21G 9/0009; D21B 1/08; D21B 1/04; B26D 11/00; B26D 2011/005; D21D 5/02

See application file for complete search history.

(56) References Cited

U.S. PATENT DOCUMENTS

| | | | | |
|---|---|---|---|---|
| 2019/0264393 | A1* | 8/2019 | Taniguchi | D21F 3/10 |
| 2021/0277600 | A1* | 9/2021 | Gomi | B27N 3/04 |

FOREIGN PATENT DOCUMENTS

| | | | |
|---|---|---|---|
| EP | 3 508 637 | A1 | 7/2019 |
| EP | 3 533 926 | A1 | 9/2019 |
| JP | H05-132843 | A | 5/1993 |

* cited by examiner

*Primary Examiner* — Eric Hug
*Assistant Examiner* — Matthew M Eslami
(74) *Attorney, Agent, or Firm* — Global IP Counselors, LLP

(57) ABSTRACT

A fiber body forming apparatus including an accumulating unit that has a release unit that releases a material containing a fiber and that has an accumulating member on which the material released from the discharging unit accumulates, a sheet substrate supply unit that supplies a sheet substrate to a position vertically below the release unit, and a control unit that controls operation of the accumulating unit and the sheet substrate supply unit, in which the control unit controls the operation of the accumulating unit and the sheet substrate supply unit to selectively execute a first mode for causing the material to accumulate on the accumulating member and the second mode for supplying the sheet substrate to the position vertically below the release unit and causing the material to accumulate on the sheet substrate.

10 Claims, 9 Drawing Sheets

FIBER BODY FORMING APPARATUS AND CONTROL METHOD OF FIBER BODY FORMING APPARATUS

The present application is based on, and claims priority from JP Application Serial Number 2020-215839, filed Dec. 24, 2020, the disclosure of which is hereby incorporated by reference herein in its entirety.

BACKGROUND

1. Technical Field

The present disclosure relates to a fiber body forming apparatus and a control method of the fiber body forming apparatus.

2. Related Art

In recent years, a dry fiber body forming apparatus that uses as little water as possible has been proposed. A general configuration of a dry fiber body forming apparatus includes a defibrating unit that defibrates a raw material, an accumulating unit that causes a defibrated product generated in the defibrating unit to accumulate, and a molding unit that molds an accumulated product generated in the accumulating unit into a sheet shape.

In addition, for a sheet to be manufactured to have desired functionality, adopting the configuration described in JP-A-5-132843 can be considered. In JP-A-5-132843, a sheet having desired functionality is manufactured by providing a nonwoven fabric, causing a glass fiber to accumulate on the nonwoven fabric, and molding the accumulated product.

However, the apparatus described in JP-A-5-132843 is a dedicated apparatus for manufacturing a functional sheet. Therefore, the apparatus does not accord with the method of manufacturing only an accumulated product into a sheet shape described above and is thereby inconvenient.

SUMMARY

The present disclosure is a fiber body forming apparatus including an accumulating unit that has a release unit that releases a material containing a fiber and that has an accumulating member on which the material released from the release unit accumulates, a sheet substrate supply unit that supplies a sheet substrate to a position vertically below the release unit, and a control unit that controls operation of the accumulating unit and the sheet substrate supply unit, in which the control unit controls the operation of the accumulating unit and the sheet substrate supply unit to selectively execute a first mode for causing the material to accumulate on the accumulating member and a second mode for supplying the sheet substrate to the position vertically below the release unit and causing the material to accumulate on the sheet substrate.

The present disclosure is a control method of a fiber body forming apparatus including an accumulating unit that has a release unit that releases a material containing a fiber and that has an accumulating member on which the material released from the release unit accumulates, and a sheet substrate supply unit that supplies a sheet substrate to a position vertically below the release unit, the control method including controlling operation of the accumulating unit and the sheet substrate supply unit to selectively execute a first mode for causing the material to accumulate on the accumulating member and a second mode for supplying the sheet substrate to the position vertically below the release unit and causing the material to accumulate on the sheet substrate.

DESCRIPTION OF EXEMPLARY EMBODIMENTS

Hereinafter, a fiber body forming apparatus of the present disclosure will be described in detail based on preferred embodiments illustrated in the accompanying drawings.

First Embodiment

Figure 1:
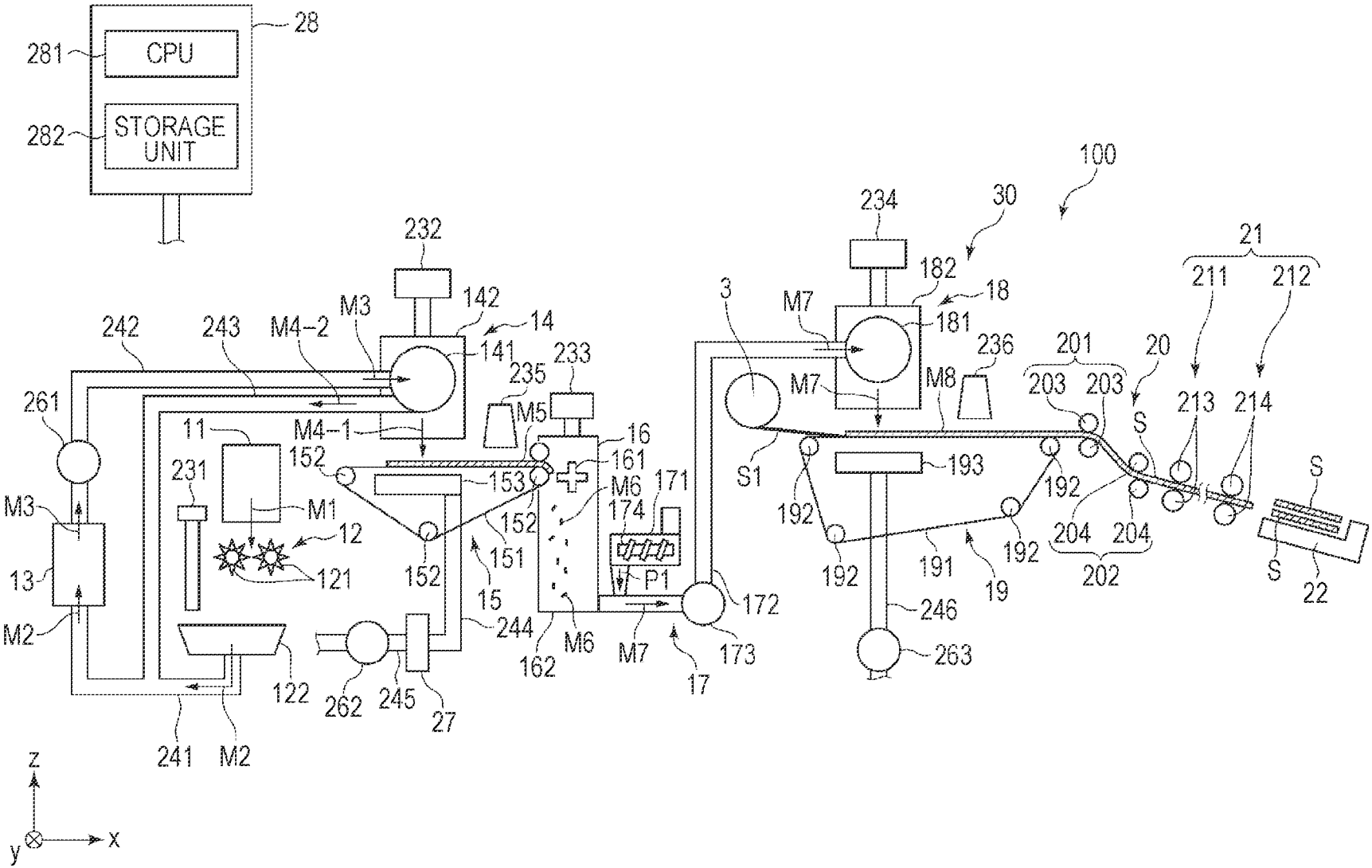
FIG. 1 is a schematic side view illustrating a first embodiment of a fiber body forming apparatus of the present disclosure.
Figure 2:
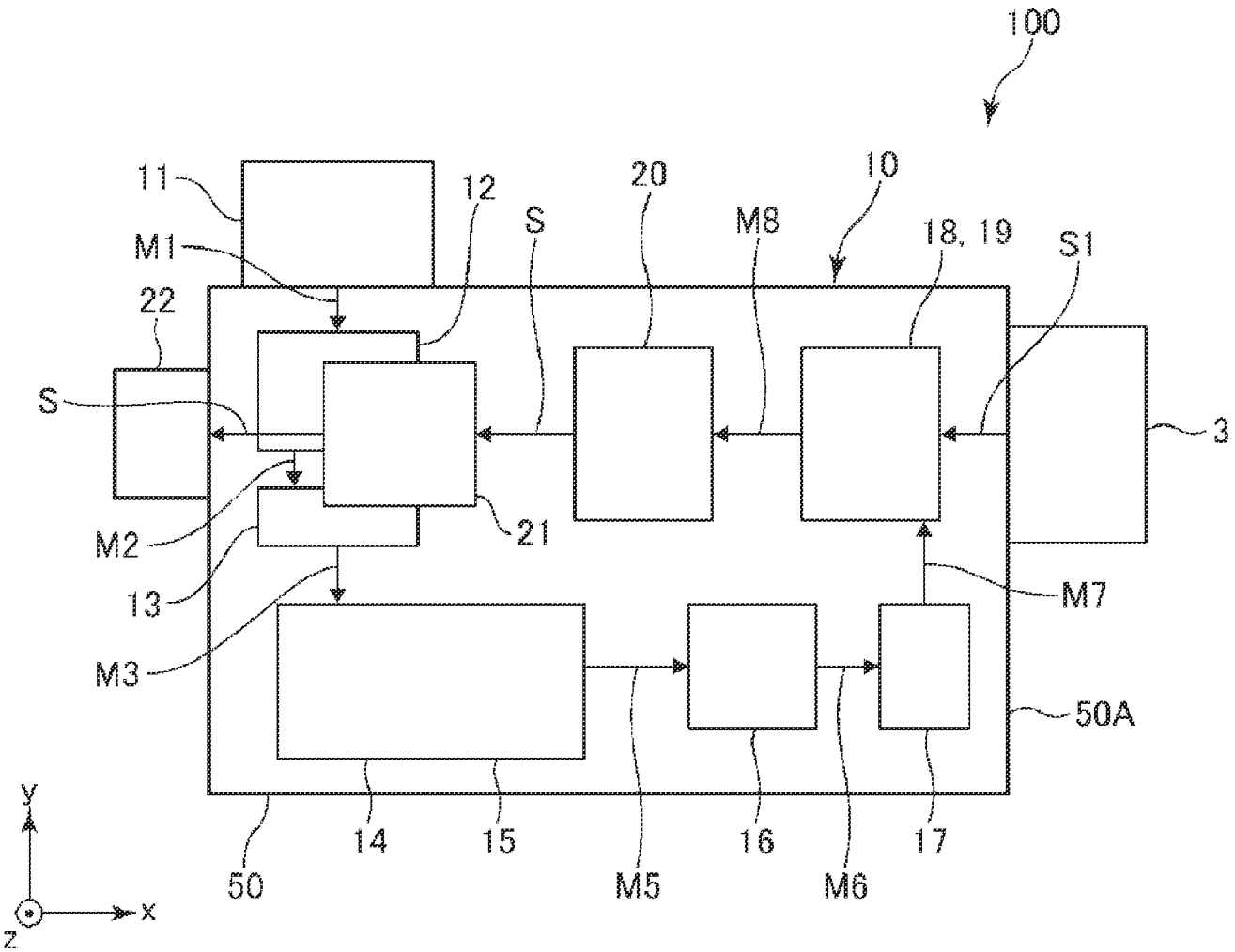
FIG. 2 is a schematic diagram illustrating positional relationships of respective portions of the fiber body forming apparatus illustrated in FIG. 1.
Figure 3:
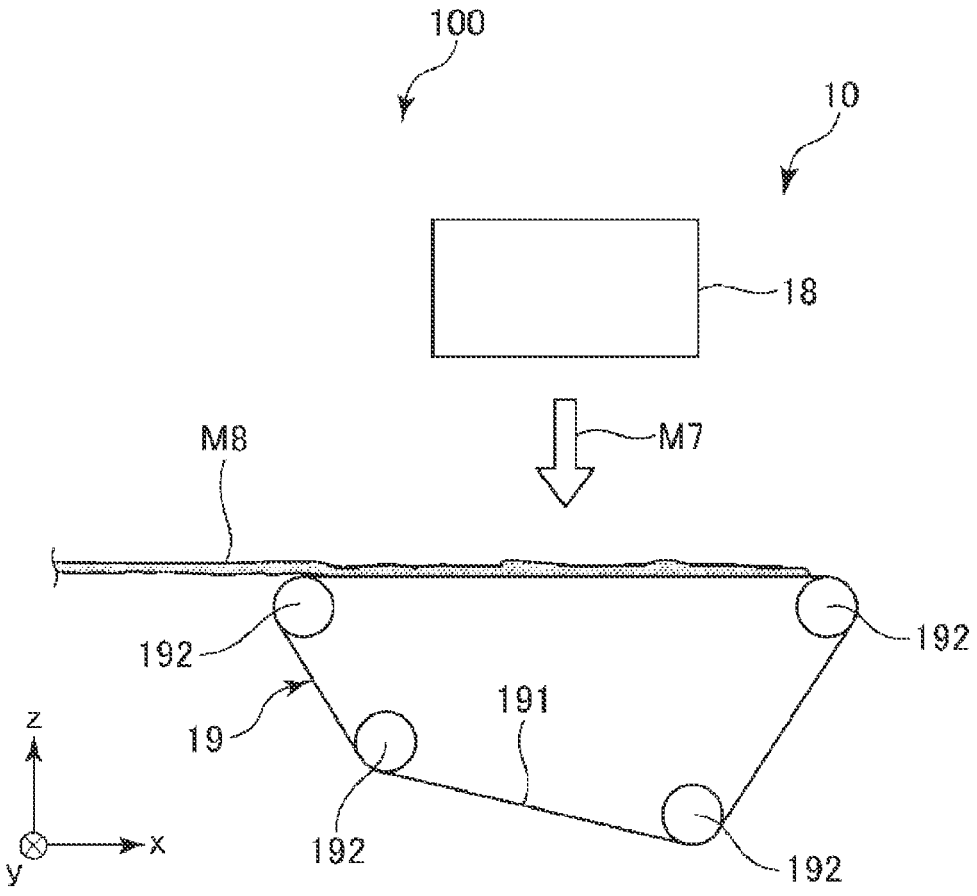
FIG. 3 is a schematic configuration diagram of an accumulating unit included in the fiber body forming apparatus illustrated in FIG. 1 and a periphery of the accumulating unit and illustrates execution of a first mode.
Figure 4:
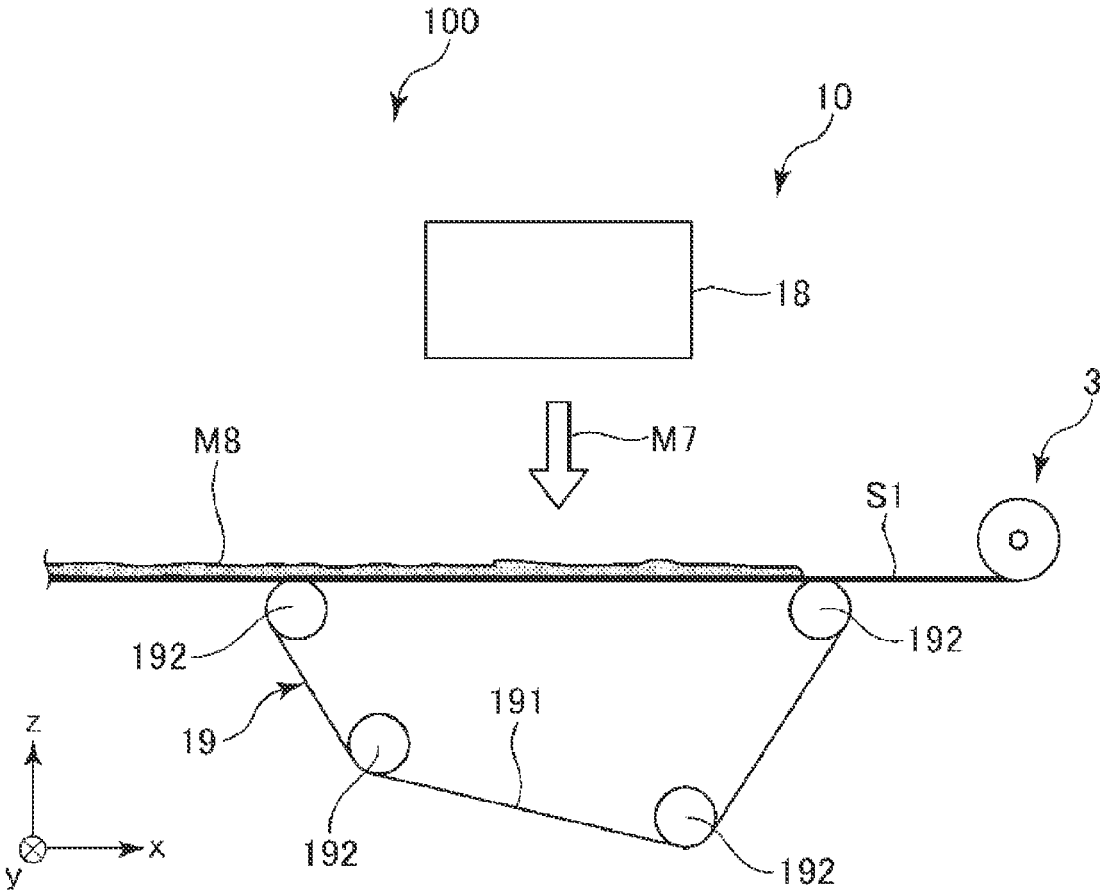
FIG. 4 is a schematic configuration diagram of the accumulating unit included in the fiber body forming apparatus illustrated in FIG. 1 and the periphery of the accumulating unit and illustrates execution of a second mode.
Figure 5:
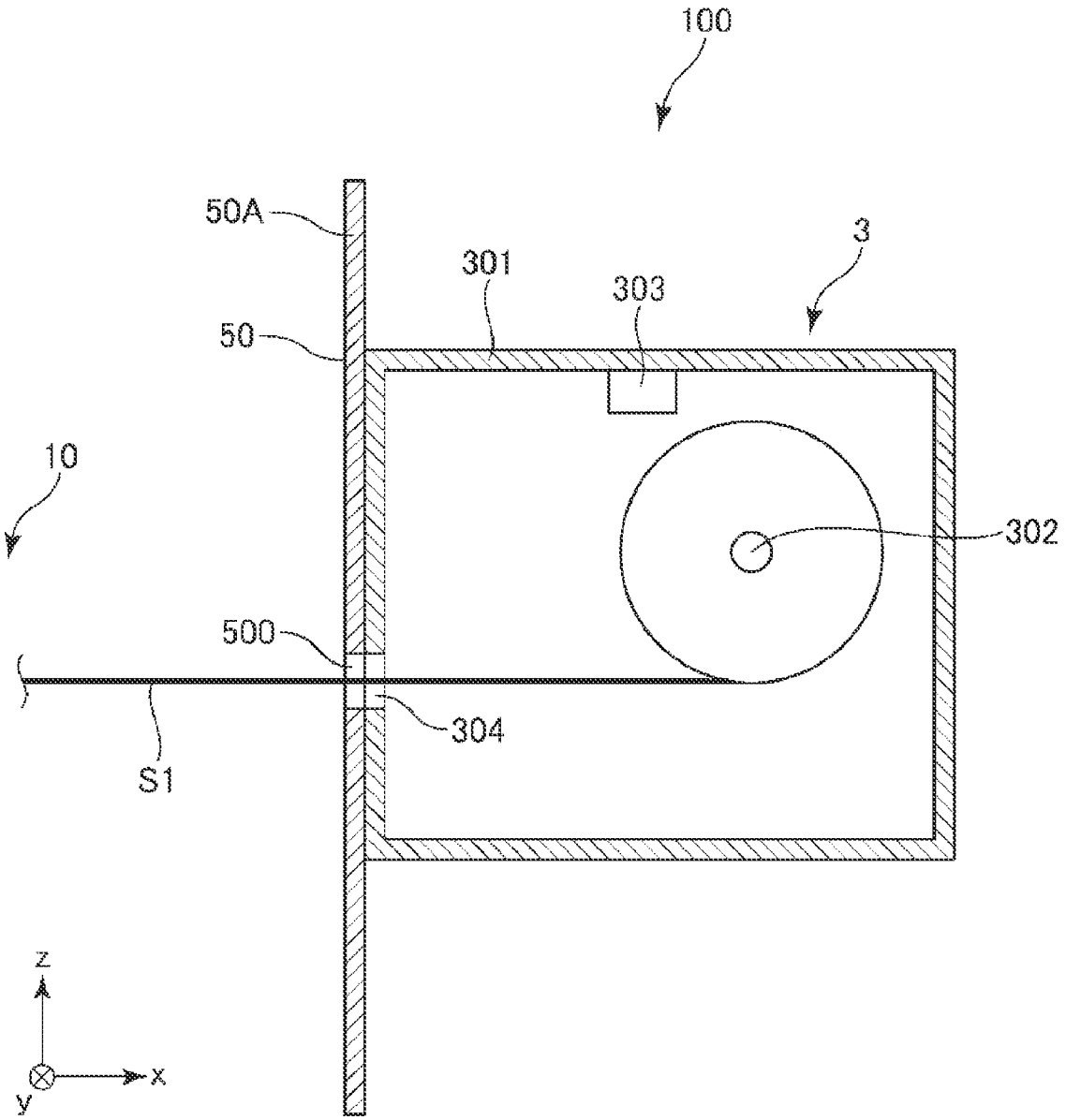
FIG. 5 is a diagram illustrating a schematic configuration of a sheet substrate supply unit included in the fiber body forming apparatus illustrated in FIG. 1.
Figure 6:
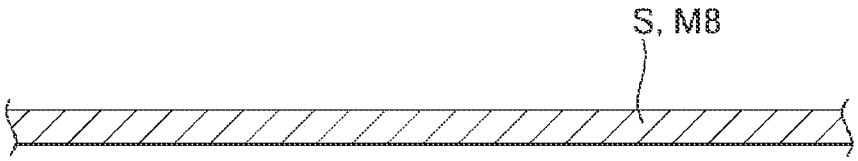
FIG. 6 is a sectional view of a sheet manufactured in the first mode of the fiber body forming apparatus illustrated in FIG. 1.
Figure 7:
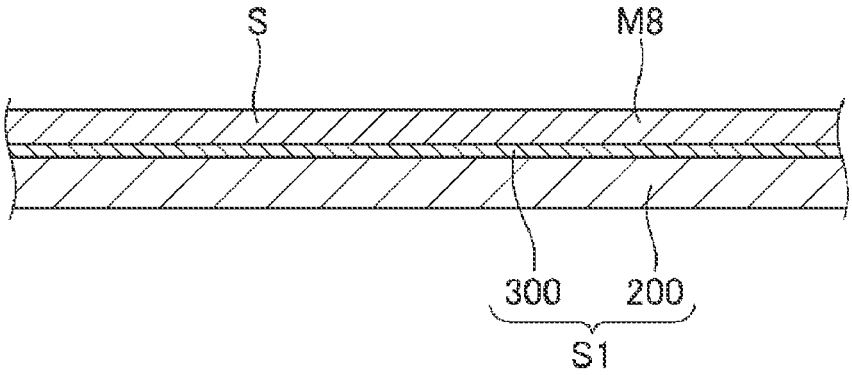
FIG. 7 is a sectional view of a sheet manufactured in the second mode of the fiber body forming apparatus illustrated in FIG. 1.
Figure 8:
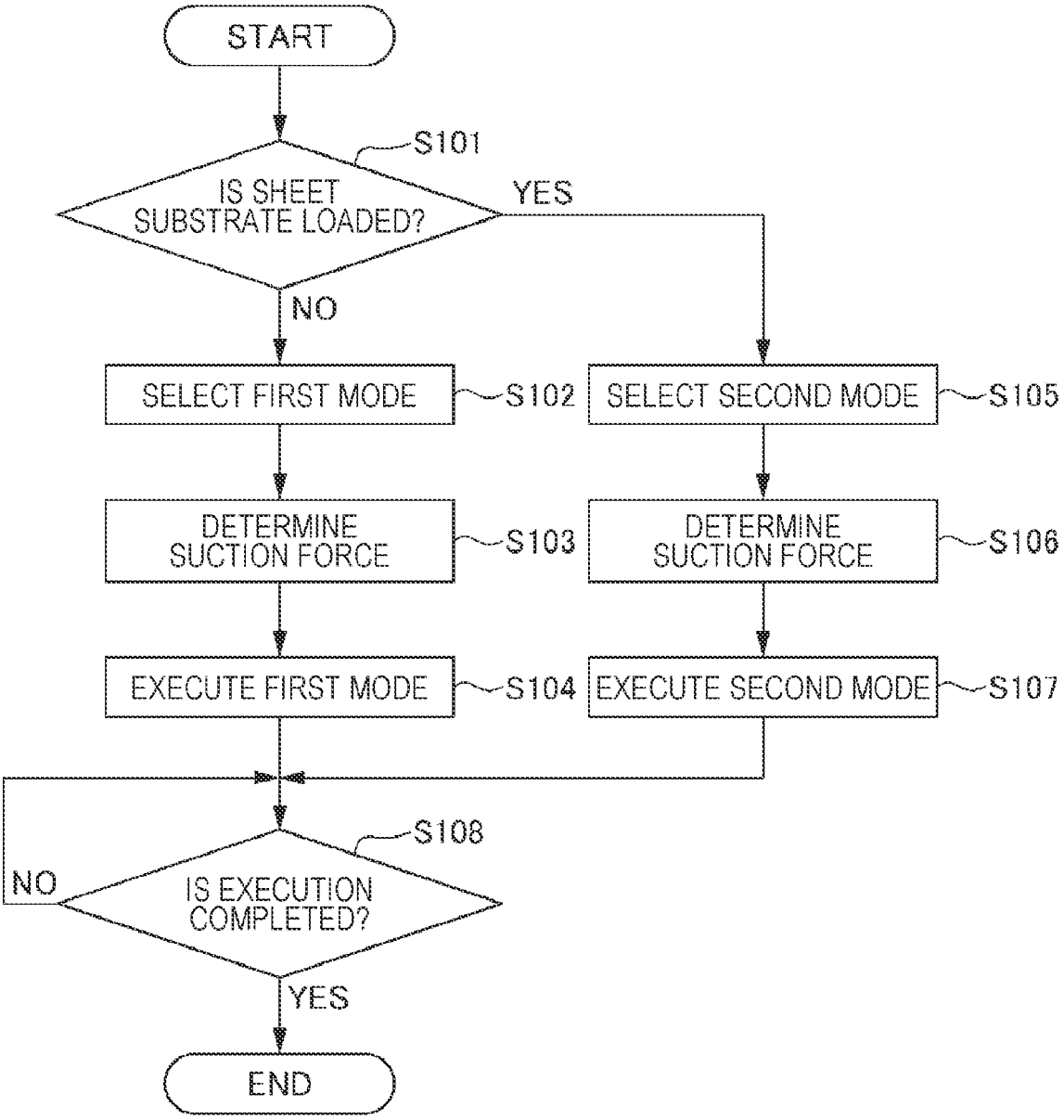
FIG. 8 is a flowchart for explaining an example of a control operation performed by a control unit illustrated in FIG. 1.

FIG. 1 is a schematic side view illustrating a first embodiment of a fiber body forming apparatus of the present disclosure. FIG. 2 is a schematic diagram illustrating positional relationships of respective portions of the fiber body forming apparatus illustrated in FIG. 1. FIG. 3 is a schematic configuration diagram of an accumulating unit included in the fiber body forming apparatus illustrated in FIG. 1 and a periphery of the accumulating unit and illustrates execution of a first mode. FIG. 4 is a schematic configuration diagram of the accumulating unit included in the fiber body forming apparatus illustrated in FIG. 1 and the periphery of the accumulating unit and illustrates execution of a second mode. FIG. 5 is a diagram illustrating a schematic configuration of a sheet substrate supply unit included in the fiber body forming apparatus illustrated in FIG. 1. FIG. 6 is a sectional view of a sheet manufactured in the first mode of the fiber body forming apparatus illustrated in FIG. 1. FIG. 7 is a sectional view of a sheet manufactured in the second mode of the fiber body forming apparatus illustrated in FIG. 1. FIG. 8 is a flowchart for explaining an example of a control operation performed by a control unit illustrated in FIG. 1.

Note that hereinafter, for convenience of explanation, as illustrated in FIGS. 2 to 5, three axes perpendicularly crossing each other are denoted as the X-axis, Y-axis, and Z-axis. Moreover, an X-Y plane including the X-axis and the Y-axis is horizontal, and the Z-axis is vertical. Furthermore, a direction in which the arrow of each axis is directed is denoted as "+" (positive), and the direction opposite thereto is denoted as "−" (negative). Furthermore, an upper side of FIGS. 1 to 4 is also referred to as up or upward, and a lower side is referred to as down or downward.

In addition, in the specification, being horizontal includes not only being exactly horizontal, but also being inclined within a range of ±5° relative to a horizontal surface. Similarly, in the specification, being vertical includes not only being exactly vertical, but also being inclined within a range of ±5° relative to a vertical surface.

Note that FIG. 1 is a schematic diagram created to be easily understood for explaining a series of processes for manufacturing a sheet S from a raw material M1. For this reason, in FIG. 1, the positional relationships of the respective portions of a fiber body forming apparatus 100 may differ from the actual positional relationships. First, the overall configuration of the fiber body forming apparatus 100 will be described.

As illustrated in FIGS. 1 and 2, the fiber body forming apparatus 100 includes a raw material supply unit 11, a crushing unit 12, a defibrating unit 13, a sorting unit 14, a first web forming unit 15, a subdividing unit 16, a mixing unit 17, a loosening unit 18, a second web forming unit 19, a heating pressurizing unit 20, a cutting unit 21, a discharging unit 22, a sheet substrate supply unit 3, a collecting unit 27, a control unit 28, and a casing 50. In addition, the loosening unit 18 and the second web forming unit 19 constitute an accumulating unit 30. Among these units, as illustrated in FIG. 2, units except for the raw material supply unit 11, the discharging unit 22, and the sheet substrate supply unit 3 are accommodated in the casing 50. Note that the control unit 28 may be accommodated inside the casing 50 or may be installed outside.

Each of the raw material supply unit 11, the crushing unit 12, the defibrating unit 13, the sorting unit 14, the first web forming unit 15, the subdividing unit 16, the mixing unit 17, the loosening unit 18, the second web forming unit 19, the heating pressurizing unit 20, the cutting unit 21, the discharging unit 22, and the collecting unit 27 is electrically coupled to the control unit 28, and operation thereof is controlled.

In addition, as illustrated in FIG. 1, the fiber body forming apparatus 100 includes a humidifying unit 231, a humidifying unit 232, a humidifying unit 233, a humidifying unit 234, a humidifying unit 235, and a humidifying unit 236. In addition, the fiber body forming apparatus 100 includes a blower 261, a blower 262, and a blower 263.

The humidifying units 231 to 236 and the blowers 261 to 263 are electrically coupled to the control unit 28, and operation thereof is controlled.

Moreover, in the fiber body forming apparatus 100, a raw material supply process, a first crushing process, a defibrating process, a sorting process, a first web forming process, a dividing process, a mixing process, a loosening process, a second web forming process, a heating pressurizing process, a cutting process, and a discharging process are performed in this order.

In addition, as will be described in detail later, the fiber body forming apparatus 100 can execute a first mode and a second mode. In the first mode, as illustrated in FIG. 3, a second web M8 is formed in the accumulating unit 30, and the second web M8 is molded into the sheet S. In the second mode, as illustrated in FIG. 4, in the accumulating unit 30, the second web M8 is caused to accumulate on a sheet substrate S1, and a layered body thereof is molded into the sheet S.

Hereinafter, a configuration of each unit will be described. As illustrated in FIGS. 1 and 2, the raw material supply unit 11 performs the raw material supply process for supplying the raw material M1 to the crushing unit 12. The raw material M1 is a sheet material made of a fiber-containing material, such as cellulosic fiber. Note that a cellulosic fiber is sufficient as long as it contains, as a main component, cellulose as a compound and has a fibrous state and may contain hemicellulose and lignin in addition to cellulose. In addition, the form of the raw material M1 is not limited and may be woven fabric, nonwoven fabric, or the like. In addition, the raw material M1 may be, for example, recycled paper produced from defibrated and reproduced waste paper or YUPO (registered trademark), which is synthetic paper, or is not limited to being recycled paper. In the present embodiment, the raw material M1 is waste paper, which has been used or is no longer needed.

As illustrated in FIG. 2, the raw material supply unit 11 is fixed to a side wall located on an −X-axis side of the casing 50. The raw material M1 supplied by the raw material supply unit 11 is supplied into the casing 50 through an introduction port (not illustrated) provided in the casing 50 and delivered to the crushing unit 12. This delivery mechanism is not particularly limited, and, for example, a delivery roller can be used.

The crushing unit 12 performs a first crushing process for crushing the raw material M1 supplied from the raw material supply unit 11 in air, such as the atmosphere. The crushing unit 12 has a pair of crushing blades 121 and a chute 122

As illustrated in FIG. 1, each of the pair of crushing blades 121 rotates around a rotation axis thereof. Since each of the crushing blades 121 rotates in a direction opposite to that of the other, the raw material M1 can be crushed, in other words, cut, between the crushing blades 121 and turned into a crushed piece M2. The shape and size of the crushed piece M2 is preferably suitable for defibrating processing in the defibrating unit 13. For example, the crushed piece M2 is a small piece, one side length of which is preferably 100 mm or less, and is more preferably 10 mm or more and 70 mm or less.

The chute 122 is disposed below the pair of crushing blades 121 and, for example, has a funnel shape. As a result, the chute 122 can receive the crushed piece M2 that has been crushed by the crushing blades 121 and fallen.

In addition, as illustrated in FIG. 1, the humidifying unit 231 is provided above the chute 122 and adjacent to the pair of crushing blades 121. The humidifying unit 231 humidifies the crushed piece M2 inside the chute 122. The humidifying unit 231 is configured by a hot air vaporizing humidifier that has a filter (not illustrated) containing moisture and causes the air to pass through the filter so as to provide the crushed piece M2 with humidified air having increased humidity. Providing the crushed piece M2 with the humidified air can suppress adhesion of the crushed piece M2 to the chute 122 due to static electricity.

The chute 122 is coupled to the defibrating unit 13 through a pipe 241. The crushed piece M2 collected in the chute 122 is transported to the defibrating unit 13 through the pipe 241.

The defibrating unit 13 performs the defibrating process for defibrating the crushed piece M2 in air, that is, in a dry manner. Through the defibrating process in the defibrating unit 13, a defibrated product M3 can be produced from the crushed piece M2. Here, defibrating refers to unraveling the crushed piece M2 formed of a plurality of fibers that has been bound into individual fibers. Each of the unraveled fibers is the defibrated product M3. The defibrated product M3 has a string shape or a belt-like shape. Alternatively, two or more of the defibrated products M3 may exist while being mutually entangled and forming a ball-like shape, that is, a so-called lump.

In the present embodiment, for example, the defibrating unit 13 has an impeller mill having a rotary blade that rotates at a high speed and a liner located in the outer periphery of the rotary blade. The crushed piece M2 that has entered the defibrating unit 13 is caught between the rotary blade and the liner and defibrated.

In addition, due to the rotation of the rotary blade, the defibrating unit 13 can generate a flow, that is, an air flow, from the crushing unit 12 toward the sorting unit 14. As a result, the crushed piece M2 can be sucked from the pipe 241 to the defibrating unit 13. Moreover, after the defibrating processing, the defibrated product M3 can be delivered to the sorting unit 14 through a pipe 242.

The blower 261 is installed in the middle of the pipe 242. The blower 261 is an air flow generator that generates an air flow toward the sorting unit 14. As a result, delivery of the defibrated product M3 to the sorting unit 14 is promoted.

The sorting unit 14 performs the sorting process for sorting the defibrated product M3 depending on the length of the fiber. In the sorting unit 14, the defibrated product M3 is sorted into a first sorted product M4-1 and a second sorted product M4-2, which is larger than the first sorted product M4-1. The size of the first sorted product M4-1 is suitable for manufacturing the sheet S, which is subsequently performed. The average length of the first sorted product M4-1 is preferably 1 μm or more and 30 μm or less. On the other hand, the second sorted product M4-2 includes, for example, insufficiently defibrated fibers and defibrated fibers that have been excessively aggregated.

The sorting unit 14 has a drum portion 141 and a housing portion 142 that accommodates the drum portion 141.

The drum portion 141 has a cylindrical mesh body functioning as a sieve that rotates around the central axis of the mesh body. The defibrated product M3 enters the drum portion 141. Then, through the rotation of the drum portion 141, the defibrated product M3 whose size is smaller than the mesh size is sorted as the first sorted product M4-1, and the defibrated product M3 whose size is equal to or greater than the mesh size is sorted as the second sorted product M4-2. The first sorted product M4-1 falls from the drum portion 141.

On the other hand, the second sorted product M4-2 is delivered to a pipe 243 coupled to the drum portion 141. The pipe 243 is coupled to the pipe 241 on a side opposite to the drum portion 141, that is, upstream. After passing through the pipe 243, the second sorted product M4-2 joins the crushed piece M2 inside the pipe 241 and enters the defibrating unit 13 together with the crushed piece M2. As a result, the second sorted product M4-2 is returned to the defibrating unit 13 and defibrated together with the crushed piece M2.

Moreover, the first sorted product M4-1 that has fallen from the drum portion 141 falls while being dispersed in the air and moves to the first web forming unit 15 located below the drum portion 141. The first web forming unit 15 performs the first web forming process for forming a first web M5 from the first sorted product M4-1. The first web forming unit 15 has a mesh belt 151, three stretching rollers 152, and a suction unit 153.

The mesh belt 151 is an endless belt on which the first sorted product M4-1 accumulates. The mesh belt 151 is stretched between the three stretching rollers 152. As the stretching rollers 152 are driven and rotated, the first sorted product M4-1 on the mesh belt 151 is transported downstream.

The size of the first sorted product M4-1 is equal to or greater than the mesh size of the mesh belt 151. Accordingly, the first sorted product M4-1 is restricted from passing through the mesh belt 151, as a result of which the first sorted product M4-1 can accumulate on the mesh belt 151. Moreover, since the first sorted product M4-1 is transported downstream together with the mesh belt 151 while accumulating on the mesh belt 151, the first sorted product M4-1 is formed as the layered first web M5.

In addition, for example, dust may be mixed in the first sorted product M4-1. The dust may be generated by, for example, crushing or defibrating. Such dust is collected by the collecting unit 27, which will be described later.

The suction unit 153 is a suction mechanism that sucks the air from below the mesh belt 151. Accordingly, the suction unit 153 can suck dust that has passed through the mesh belt 151 together with the air.

In addition, the suction unit 153 is coupled to the collecting unit 27 through a pipe 244. The dust sucked by the suction unit 153 is collected by the collecting unit 27.

The collecting unit 27 is further coupled to a pipe 245. Moreover, the blower 262 is installed in the middle of the pipe 245. The operation of the blower 262 can generate a suction force in the suction unit 153. As a result, formation of the first web M5 on the mesh belt 151 is promoted. Here, dust has been removed from the first web M5. In addition, by the operation of the blower 262, the dust reaches the collecting unit 27 through the pipe 244.

The housing portion 142 is coupled to the humidifying unit 232. The humidifying unit 232 a vaporizing or ultrasonic humidifier. Accordingly, humidified air is supplied into the housing portion 142. The humidified air can humidify the first sorted product M4-1 and thus also suppress adhesion of the first sorted product M4-1 to an inner wall of the housing portion 142 due to static electricity.

The humidifying unit 235 is disposed downstream of the sorting unit 14. The humidifying unit 235 is configured by an ultrasonic humidifier that sprays water. As a result, moisture can be supplied to the first web M5, and thus the moisture content of the first web M5 can be adjusted. By this adjustment, clinging of the first web M5 onto the mesh belt 151 due to static electricity can be suppressed. As a result, the first web M5 can easily peel off the mesh belt 151 at a position where the mesh belt 151 is folded back on one of the stretching rollers 152.

The subdividing unit 16 is disposed downstream of the humidifying unit 235. The subdividing unit 16 performs the dividing process for dividing the first web M5 that has peeled off the mesh belt 151. The subdividing unit 16 has a rotatably supported propeller 161 and a housing portion 162 that accommodates the propeller 161. The first web M5 can be divided by the rotating propeller 161. The divided first web M5 becomes a subdivided body M6. Moreover, the subdivided body M6 falls inside the housing portion 162.

The housing portion 162 is coupled to the humidifying unit 233. The humidifying unit 233 is configured by a vaporizing or ultrasonic humidifier. As a result, humidified air is supplied into the housing portion 162. The humidified air can suppress adhesion of the subdivided body M6 to the propeller 161 and an inner wall of the housing portion 162 due to static electricity.

The mixing unit 17 is disposed downstream of the subdividing unit 16. The mixing unit 17 performs the mixing process for mixing the subdivided body M6 with resin P1. The mixing unit 17 has a resin supply unit 171, a pipe 172, and a blower 173.

The pipe 172 couples the housing portion 162 of the subdividing unit 16 to a housing portion 182 of the loosening unit 18 and is a passage through which a mixture M7 of the subdivided body M6 and the resin P1 passes.

The resin supply unit 171 is coupled in the middle of the pipe 172. The resin supply unit 171 has a screw feeder 174. As the screw feeder 174 is driven and rotated, the resin P1 can be supplied to the pipe 172 as powder or a particle. The resin P1 supplied to the pipe 172 becomes the mixture M7 after being mixed with the subdivided body M6.

Note that the resin P1 binds fibers in a subsequent process, and, for example, a thermoplastic resin, a curable resin, and the like can be used, but a thermoplastic resin is preferably used. Examples of the thermoplastic resin include AS resin, ABS resin, polyolefin such as polyethylene, polypropylene, and an ethylene-vinyl acetate copolymer (EVA), acrylic resin such as modified polyolefin and polymethyl methacrylate, polyvinyl chloride, polystyrene, polyester such as polyethylene terephthalate and polybutylene terephthalate, polyamide (nylon) such as nylon 6, nylon 46, nylon 66, nylon 610, nylon 612, nylon 11, nylon 12, nylon 6-12, and nylon 6-66, polyphenylene ether, polyacetal, polyether, polyphenylene oxide, polyether ether ketone, polycarbonate, polyphenylene sulfide, thermoplastic polyimide, polyether imide, a liquid crystal polymer such as aromatic polyester, various thermoplastic elastomers such as styrene-based, polyolefin-based, polyvinyl chloride-based, polyurethane-based, polyester-based, polyamide-based, polybutadiene-based, trans-polyisoprene-based, fluororubber-based, and chlorinated polyethylene-based thermoplastic elastomers, and the like, and one kind or a combination of two or more kinds selected from these materials may be used. Polyester or resin containing polyester is preferably used for the thermoplastic resin.

Note that examples of a material supplied from the resin supply unit 171 may include, in addition to the resin P1, a colorant for coloring fibers, an aggregation inhibiter for inhibiting fibers or the resin P1 from aggregating, a flame retardant for making fibers and the like flame-retardant, a paper strengthening agent for improving the paper strength of the sheet S, and the like. Alternatively, a composite of these materials contained in the resin P1 may be supplied from the resin supply unit 171.

Moreover, in the middle of the pipe 172, a blower 173 is installed downstream of the resin supply unit 171. By an action of a rotation unit such as a blade included in the blower 173, the subdivided body M6 is mixed with the resin P1. In addition, the blower 173 can generate an air flow toward the loosening unit 18. By this air flow, the subdivided body M6 and the resin P1 can be stirred inside the pipe 172. As a result, the mixture M7 can enter the loosening unit 18 while the subdivided body M6 and the resin P1 are uniformly dispersed. Moreover, the subdivided body M6 in the mixture M7 is loosened while passing through the pipe 172 and has a finer fibrous shape.

The loosening unit 18 performs the loosening process for loosening fibers mutually entangled in the mixture M7. The loosening unit 18 has a drum portion 181 and the housing portion 182 that accommodates the drum portion 181.

The drum portion 181 has a cylindrical mesh body functioning as a sieve that rotates around the central axis of the mesh body. The mixture M7 enters the drum portion 181. Then, through the rotation of the drum portion 181, a fiber or the like in the mixture M7 that is smaller than the mesh size can pass through the drum portion 181. At this time, the mixture M7 is loosened.

The housing portion 182 is coupled to the humidifying unit 234. The humidifying unit 234 is configured by a vaporizing or ultrasonic humidifier so as to supply humidified air into the housing portion 182. The humidified air can humidify the inside of the housing portion 182 and thus also suppress adhesion of the mixture M7 to an inner wall of the housing portion 182 due to static electricity.

In addition, the mixture M7 that has been loosened in the drum portion 181 falls while being dispersed in the air and moves to the second web forming unit 19 located below the drum portion 181. The second web forming unit 19 performs the second web forming process for forming the second web M8 from the mixture M7. The second web forming unit 19 has a mesh belt 191, stretching rollers 192, and a suction unit 193.

The mesh belt 191 is an endless belt and is an accumulating member on which the mixture M7 accumulates. The mesh belt 191 is stretched between the four stretching rollers 192. As the stretching rollers 192 are driven and rotated, the mixture M7 on the mesh belt 191 is transported downstream.

The size of most of the mixture M7 on the mesh belt 191 is equal to or greater than that of the mesh size of the mesh belt 191. Accordingly, the mixture M7 is restricted from passing through the mesh belt 191, as a result of which the mixture M7 can accumulate on the mesh belt 191. Moreover, since the mixture M7 is transported downstream together with the mesh belt 191 while accumulating on the mesh belt 191, the mixture M7 is formed as the layered second web M8.

The suction unit 193 is a suction mechanism that sucks the air from below the mesh belt 191. Accordingly, the suction unit 193 can suck the mixture M7 onto the mesh belt 191 and can thus promote accumulation of the mixture M7 on the mesh belt 191.

A pipe 246 is coupled to the suction unit 193. Moreover, the blower 263 is installed in the middle of the pipe 246. The operation of the blower 263 can generate a suction force in the suction unit 193. The blower 263 is electrically coupled to the control unit 28, and operation thereof is controlled.

The loosening unit 18 and the second web forming unit 19 described above form the accumulating unit 30 that accumulates the defibrated product M3 generated in the defibrating unit 13.

Note that in the present embodiment, the mesh belt 191 is exemplified as an example of an accumulating member, but the present disclosure is not limited thereto, and the accumulating member may be a nonporous belt, a plate-like member, or the like.

The humidifying unit 236 is disposed downstream of the loosening unit 18. The humidifying unit 236 is configured by an ultrasonic humidifier similar to the humidifying unit 235. As a result, moisture can be supplied to the second web M8, and thus the moisture content of the second web M8 can be adjusted. By this adjustment, clinging of the second web M8 onto the mesh belt 191 due to static electricity can be suppressed. As a result, the second web M8 can easily peel off the mesh belt 191 at a position where the mesh belt 191 is folded back on one of the stretching rollers 192.

Note that the total moisture content added by the humidifying units 231 to 236 is preferably, for example, 0.5 parts by mass or more and 20 parts by mass or less with respect to 100 parts by mass of the material before humidification.

The heating pressurizing unit 20 is disposed downstream of the second web forming unit 19. The heating pressurizing unit 20 performs the heating pressurizing process for forming the sheet S from the second web M8. The heating pressurizing unit 20 has a pressurizing unit 201 and a heating unit 202.

The pressurizing unit 201 has a pair of calender rollers 203 and can pressurize the second web M8 between the calender rollers 203 without heating the second web M8. As a result, the density of the second web M8 can be increased. Note that the degree of pressurizing at this time is preferably, for example, a degree at which the resin P1 does not melt. Then, the second web M8 is transported toward the heating unit 202. Note that one of the pair of calender rollers 203 is a driving roller driven by a motor (not illustrated) and the other is a driven roller.

The heating unit 202 has a pair of heating rollers 204 and can pressurize the second web M8 while heating the second web M8 between the heating rollers 204. By heating and pressurizing the second web M8 in this manner, the resin P1 melts in the second web M8, and fibers are bound via the melted resin P1. As a result, the sheet S is formed. Then, the sheet S is transported toward the cutting unit 21. Note that one of the pair of heating rollers 204 is a driving roller driven by a motor (not illustrated) and the other is a driven roller.

The cutting unit 21 is disposed downstream of the heating pressurizing unit 20. The cutting unit 21 performs the cutting process for cutting the sheet S. The cutting unit 21 has a first cutting unit 211 and a second cutting unit 212.

The first cutting unit 211 cuts the sheet S in a direction intersecting, in particular, in a direction orthogonal to a direction in which the sheet S is transported.

Downstream of the first cutting unit 211, the second cutting unit 212 cuts the sheet S in a direction parallel to the direction in which the sheet S is transported. This cutting is for removing both ends of the sheet S, that is, unnecessary excess portions of ends in the +Y axis direction and in the −Y axis direction, so as to adjust the width of the sheet S. The excess portions that have been cut and removed are so-called edges.

Each unit included in the fiber body forming apparatus 100 described above is electrically coupled to the control unit 28. Operation of each unit is controlled by the control unit 28.

The control unit 28 has a central processing unit (CPU) 281 and a storage unit 282. The CPU 281 can perform, for example, various types of determination, various instructions, and the like.

The storage unit 282 stores, for example, various programs, such as a program for manufacturing the sheet S, and the like. In addition, the storage unit 282 stores an operation program in the first mode and an operation program in the second mode, and the CPU 281 selectively reads and executes the operation programs.

Moreover, the control unit 28 may be incorporated in the fiber body forming apparatus 100 or provided in an external device such as an external computer. Furthermore, the fiber body forming apparatus 100 may be coupled to the external device in a wired or wireless manner and may be coupled via a network such as the Internet.

In addition, the CPU 281 and the storage unit 282 may be, for example, integrated and configured as one unit, the storage unit 282 may be provided in an external device such as an external computer while the CPU 281 is incorporated in the fiber body forming apparatus 100, and the CPU 281 may be provided in an external device such as an external computer while the storage unit 282 is incorporated in the fiber body forming apparatus 100.

Next, the positional relationship of each unit of the fiber body forming apparatus 100 will be described with reference to FIG. 2. As illustrated in FIG. 2, each unit of the fiber body forming apparatus 100 described earlier is accommodated in the casing 50. FIG. 2 illustrates only main units of the fiber body forming apparatus 100, and other units are omitted.

The raw material supply unit 11 is disposed at a position biased toward the −X-axis side of the side wall on the +Y-axis side of the casing 50. The discharging unit 22 is disposed at a position biased toward the +Y-axis side of the side wall on the −X-axis side. The raw material M1 discharged from the raw material supply unit 11 enters the casing 50 from the +Y-axis side and is supplied to the crushing unit 12. The crushed piece M2 generated in the crushing unit 12 is delivered to the −Y-axis side and defibrated in the defibrating unit 13. The defibrated product M3 generated in the defibrating unit 13 is delivered to the −Y-axis side and accumulates in the sorting unit 14 and the first web forming unit 15 and becomes the first web M5. The first web M5 is delivered to the +X-axis side, is supplied to the subdividing unit 16, and becomes the subdivided body M6. The subdivided body M6 is delivered to the +X-axis side and becomes the mixture M7 in the mixing unit 17. The mixture M7 is delivered to the loosening unit 18 and the second web forming unit 19 on the +Y-axis side, and the second web M8 is generated. The second web M8 is delivered to the −X-axis side and molded into the sheet S in the heating pressurizing unit 20. The sheet S is further delivered to the −X-axis side, cut into the individual sheet S in the cutting unit 21, delivered to the −X-axis side, and discharged from the casing 50. The discharged sheet S is stored in the discharging unit 22.

In this way, in the casing 50, the raw material M1 moves to the +X-axis side, is folded back at a position on the +X-axis side in the casing 50, and moves toward the −X-axis side. In other words, since the transportation route of the raw material M1 is folded back at a halfway position, the total length, that is, the length in the X-axis direction of the fiber body forming apparatus 100, can be reduced. Therefore, for example, even inside a building having limited space, the number of places where the fiber body forming apparatus 100 can be installed is increased, and the fiber body forming apparatus 100 can be easily installed in various places.

The accumulating unit 30 is provided at a position directly after the position at which the route is folded back, that is, at a position on the +y-axis side and biased toward the +X-axis side inside the casing 50. In other words, the accumulating unit 30 is installed near a side wall 50A on the +X-axis side of the casing 50.

In this way, the sheet substrate supply unit 3 charges the sheet substrate S1 at a position immediately before the position of the accumulating unit 30 on the route where the raw material M1, which is the material, is transported. As a result, directly after the sheet substrate supply unit 3 charges the sheet substrate S1, the second web M8 can be formed on the sheet substrate S1. Accordingly, an unnecessary route for the sheet substrate S1 is not created inside the apparatus, and the size of the apparatus can be reduced.

The sheet substrate supply unit 3 is provided on the +X-axis side of the side wall 50A on the +X-axis side of the casing 50. The sheet substrate supply unit 3 has a function of supplying the sheet substrate S1 in the second mode.

As illustrated in FIG. 5, the sheet substrate supply unit 3 has a casing 301 installed on a surface on the +X-axis side of the side wall 50A, a loading portion 302 provided inside the casing 301 into which a raw sheet of the sheet substrate S1 is loaded, and a detecting unit 303 that detects the sheet substrate S1. The raw sheet of the sheet substrate S1 is an elongated sheet substrate S1 that is wound into a roll having a hollow central portion.

The casing 301 has a supply port 304 that is in communication with an introduction port 500 provided on the side wall 50A and from which the sheet substrate S1 is supplied. Moreover, in the casing 301, an opening/closing port (not illustrated) is provided, and the raw sheet of the sheet substrate S1 can be loaded or separated through the opening/closing port.

In addition, in the illustrated configuration, the loading portion 302 is constituted by a rod-like member that is inserted into the central portion of the raw sheet of the sheet substrate S1. However, the loading portion 302 is not limited to this configuration and, for example, may have a configuration in which the raw sheet of the sheet substrate S1 is simply supported from below or may have a configuration in which two rod-like members are inserted into the central portion of the raw sheet of the sheet substrate S1 from both sides.

In addition, the rod-like member may have a configuration in which the rod-like member is caused to rotate by a motor (not illustrated) being driven to unroll the sheet substrate S1 or may have a configuration in which a start end of the sheet substrate S1 is pinched by each pair of rollers of the heating pressurizing unit 20 and the like and pulled out to be unrolled while the rod-like member does not rotate.

In this way, the sheet substrate S1 is wound into a roll, and in the second mode, the sheet substrate supply unit 3 unrolls and supplies the rolled sheet substrate S1. As a result, the sheet substrate S1 can be accommodated in a small storage space, and a greater amount of the sheet substrate S1 can be fed. This configuration can contribute to space saving while reducing the frequency of supplying the sheet substrate S1.

As illustrated in FIG. 7, the sheet substrate S1 has a substrate layer 200 and a function member 300 provided on a side of one surface of the substrate layer 200.

The substrate layer 200 is, for example, a nonwoven fabric. The nonwoven fabric that constitutes the substrate layer 200 is preferably formed of a fiber having the same molecular structure as a fiber released from the loosening unit 18. Examples of a fiber contained in the sheet substrate S1 include cellulosic fiber, rayon, cotton, lint, kapok, flax, hemp, ramie, and the like, and one kind or a combination of two or more kinds of these materials may be used. As a fiber contained in the substrate layer 200, cellulosic fiber is preferably used. Cellulosic fiber can be easily obtained and has excellent moldability. As a cellulosic fiber, a fiber derived from wood pulp is preferable. Examples of wood pulp include virgin pulp, kraft pulp, bleached chemithermo mechanical pulp, synthetic pulp, and pulp derived from waste paper and recycled paper, and one kind or a combination of two or more kinds of these materials may be used.

In addition, the substrate layer 200 is air permeable. Air permeability is a property enabling air to pass through a plurality of pores. When indicated by a Gurley number, which indicates air permeability in a Gurley tester method, the Gurley number of the substrate layer 200 is preferably less than 30 seconds, and more preferably less than 15 seconds. As a result, when the suction unit 193 sucks the mixture M7 in the second mode, the mixture 7 can be satisfactorily sucked via the sheet substrate S1. Therefore, the second web M8 can be formed in a good condition on the sheet substrate S1.

The thickness of the substrate layer 200 is not particularly limited and is preferably, for example, 50 μm or more and 200 μm or less, and more preferably 90 μm or more and 150 μm or less.

As the function member 300, for example, a magnetic body can be used. As a result, the sheet S manufactured in the second mode can be used as security paper. Security paper is paper detectable by a detection system that includes an excitation coil and a detection coil. When an alternating current flows through the excitation coil to generate an alternating current field of several kHz and the sheet S is placed in the alternating current field, the existence of the sheet S can be detected at the time of magnetization inversion. Therefore, by disposing the excitation coil and the detection coil at an access point through which a person or a vehicle passes, the sheet S passing through the access point can be detected.

Accordingly, bring-out of the sheet S can be detected. For example, when confidential information and the like is printed on the sheet S, leakage of confidential information can be prevented.

Moreover, the function member 300 preferably has a large Barkhausen effect. Specifically, the functional material of the function member 300 may be FeCr-based, FeCo-based, FeNi-based, FeSiB-based, and FeCoCrSiB-based alloys. These materials exhibit a large Barkhausen effect even when strain is not added by post-processing and are thus preferably used. Note that a large Barkhausen effect can be conferred by adding strain by post-processing. Moreover, the function member 300 may be a wire made of a cut amorphous ribbon or a glass coating wire that is cooled after the same metal in a melted state is drawn together with glass.

The function member 300 preferably has a linear longitudinal shape such as a wire shape or a ribbon shape. Having a prescribed length with respect to a cross-sectional area helps the function member 300 easily exhibit a large Barkhausen effect.

Note that the function member 300 is not limited to being a magnetic body. For example, the function member 300 may be a metal wire detectable by a metal detector, a radio frequency (RF) tag detectable by a radio frequency identification (RFID) reader, or an integrated circuit (IC) chip.

As described above, the sheet substrate S1 has the air permeable substrate layer 200 containing a fiber and has the function member 300 carried on the substrate layer 200. As a result, desired functionality can be conferred to the sheet S to be manufactured. Moreover, since the substrate layer 200 is air permeable, when the suction unit 193 sucks the mixture M7 in the second mode, the mixture M7 can be satisfactorily sucked via the sheet substrate S1. As a result, the second web M8 can be formed in a good condition on the sheet substrate S1.

Moreover, the function member 300 is bonded to a surface, that is, on a side of one surface of the substrate layer 200. However, the present disclosure is not limited to this configuration, and the function member 300 may be embedded in the substrate layer 200.

Moreover, the raw sheet of the sheet substrate S1 is the sheet substrate S1 that is wound so that the function member 300 is positioned on an inner side. Then, the sheet substrate supply unit 3 supplies the sheet substrate S1 in a direction in which the function member 300 is positioned on the side of the loosening unit 18. This means that the accumulating unit 30 causes the mixture M7, which is the material, to accumulate so that the mixture M7 covers the function member 300 exposed on a surface of the sheet substrate S1. As a result, the second web M8 functions as a hiding layer that hides the function member 300 after molding.

The detecting unit 303 detects whether or not the raw sheet of the sheet substrate S1 is loaded into the loading portion 302. A detecting method of the detecting unit 303 is not particularly limited, and examples include a reflection-type or transmission-type optical method, a pressure-sensitive method that detects weight, an electrostatic method, a magnetic method, an energization detection method, and the like.

The detecting unit 303 is electrically coupled to the control unit 208, and a detection result detected by the detecting unit 303 is transmitted to the control unit 28.

Here, in the fiber body forming apparatus 100, the first mode and the second mode can be selectively executed. In the first mode, as illustrated in FIG. 3, in the accumulating unit 30, the second web M8 is formed to be molded into the sheet S. In the second mode, as illustrated in FIG. 4, in the accumulating unit 30, the second web M8 is caused to accumulate on the sheet substrate S1, and a layered body thereof is molded into the sheet S. The sheet S manufactured in the first mode is a reproduced product of the raw material M1 and can be reused as printing paper and the like. On the other hand, the sheet S manufactured in the second mode has the function member 300 as described earlier, and the sheet S having desired functionality such as a security sheet can be obtained. In this way, the fiber body forming apparatus 100 has advantages of both a dedicated apparatus for the first mode and a dedicated apparatus for the second mode and is thereby convenient.

In addition, the sheet substrate supply unit 3 includes the loading portion 302 into which the sheet substrate S1 is loaded and the detecting unit 303 that detects whether or not the sheet substrate S1 is loaded into the loading portion 302. The control unit 28 selects the first mode or the second mode depending on the detection result of the detecting unit 303. As a result, the first mode or the second mode can be appropriately selected and executed in accordance with the presence of the sheet substrate S1 in the sheet substrate supply unit 3.

In addition, in the present embodiment, when the detecting unit 303 detects loading of the sheet substrate S1 into the loading portion 302, the control unit 28 selects the second mode, and when the detecting unit 303 does not detect loading of the sheet substrate S1 into the loading portion 302, the control unit 28 selects the first mode. As a result, the first mode or the second mode can be selected and executed by taking into account an operator's intention of whether or not to load the sheet substrate S1 into the loading portion 302.

As described thus far, the fiber body forming apparatus 100 of the present disclosure includes the accumulating unit 30 that has the loosening unit 18 that is a release unit for releasing the mixture M7 that is the material containing a fiber and that has the mesh belt 191 that is an accumulating member on which the mixture M7 that is the material released from the loosening unit 18 accumulates, the sheet substrate supply unit 3 that supplies the sheet substrate S1 to a position vertically below the loosening unit 18, and the control unit 28 that controls the operation of the accumulating unit 30 and the sheet substrate supply unit 3. Next, the control unit 28 controls the operation of the accumulating unit 30 and the sheet substrate supply unit 3 to selectively execute the first mode for causing the mixture M7 to accumulate on the mesh belt 191 and the second mode for supplying the sheet substrate S1 to the position vertically below the loosening unit 18 and causing the mixture M7 to accumulate on the sheet substrate S1. According to this configuration, the fiber body forming apparatus 100 has advantages of both a dedicated apparatus for the first mode and a dedicated apparatus for the second mode. Accordingly, the fiber body forming apparatus 100 can select these modes and is thereby convenient.

In addition, in the second mode, the sheet substrate supply unit 3 supplies the sheet substrate S1 on the mesh belt 191, which is an accumulating member. As a result, the second web M8 can be stably supplied while the sheet substrate S1 is supported. As a result, the quality of the sheet S can be improved.

Note that in the second mode, a configuration in which the second web M8 is supplied on the sheet substrate S1 that is transported in air after the mesh belt 191 retreats may be adopted.

In addition, the accumulating member is the mesh belt 191, and the accumulating unit 30 has the suction unit 193 that is provided on a side of a surface, of the mesh belt 191, opposite to a side on which the mixture M7, which is the material, accumulates and that sucks the mixture M7 or the second web M8 through the mesh belt 191. As a result, in the first mode and the second mode, the second web M8 can be formed in a good condition.

Next, using the flowchart illustrated in FIG. 8, an example of a control method of the fiber body forming apparatus of the present disclosure will be described.

First, in step S101, whether or not the sheet substrate S1 is loaded is determined. The determination in this step is made based on the detection result of the detecting unit 303. When it is determined that the sheet substrate S1 is not loaded in step S101, the first mode is selected in step S102.

Next, in step S103, the suction force of the suction unit 193 is determined. Specifically, conditions for energizing the blower 263 are set as energizing conditions of the first mode, which are stored in the storage unit 282 in advance.

Subsequently, in the step S104, the first mode is executed under the conditions set in step S102 and step S103.

On the other hand, when it is determined that the sheet substrate S1 is loaded in step S101, the second mode is selected in step S105.

Subsequently, in step S106, the suction force of the suction unit 193 is determined. Specifically, conditions for energizing the blower 263 are set as energizing conditions of the second mode, which are stored in the storage unit 282 in advance. In this step, the suction force in the second mode is set higher than the suction force in the first mode. As a result, suction can be performed by taking into account that the suction force applied to the mixture M7 that is dispersed declines due to the existence of the sheet substrate S1. As a result, although the sheet substrate S1 exists in the second mode, satisfactory suction can be performed, and the quality of the sheet S to be obtained can be improved.

Note that as an example of means for adjusting the suction force of the suction unit 193, a case in which the conditions for energizing the blower 263 are changed is described, but the present disclosure is not limited thereto. For example, a configuration in which clearance between the suction unit 193 and the mesh belt 191 is adjusted, or a configuration in which an opening diameter of a suction port of the suction unit 193 is decreased or increased may be adopted.

Subsequently, in step S107, the second mode is executed under the conditions set in step S105 and step S106.

Subsequently, in step S108, it is determined whether or not the execution is completed. The determination in this step is made based on, for example, whether or not the number of the manufactured sheets S has reached a prescribed number or whether or not the amount of the supplied raw material M1 has reached a prescribed amount.

As described above, the control method of the fiber body forming apparatus of the present disclosure is a control method of the fiber body forming apparatus 100 including the accumulating unit 30 that has the loosening unit 18 that is a release unit for releasing the mixture M7 containing a fiber and that has the mesh belt 191 that is an accumulating member on which the mixture M7 released from the loosening unit 18 accumulates, and the sheet substrate supply unit 3 that supplies the sheet substrate S1 to a position vertically below the loosening unit 18, the control method including controlling operation of the accumulating unit 30 and the sheet substrate supply unit 3 to selectively execute the first mode for causing the mixture M7 to accumulate on the mesh belt 191 and the second mode for supplying the sheet substrate S1 to the position vertically below the loosening unit 18 and causing the mixture M7 to accumulate on the sheet substrate S1. According to this configuration, the fiber body forming apparatus 100 has advantages of both a dedicated apparatus for the first mode and a dedicated apparatus for the second mode. Accordingly, the fiber body forming apparatus 100 can select these modes and is thereby convenient.

Second Embodiment

Figure 9:
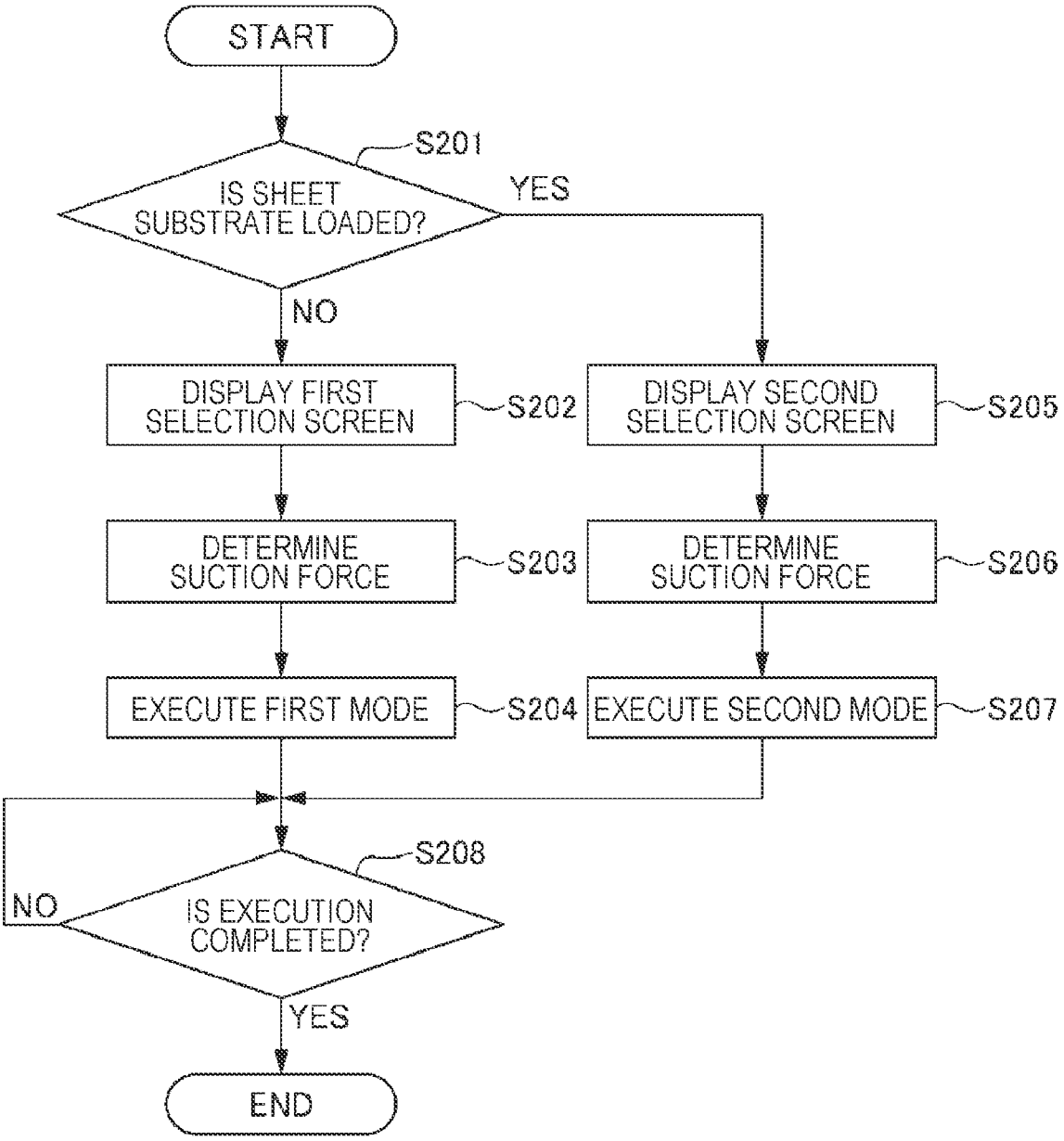
FIG. 9 is a flowchart for explaining an example of a control operation performed by a control unit included in a second embodiment of the fiber body forming apparatus of the present disclosure.
Figure 10:
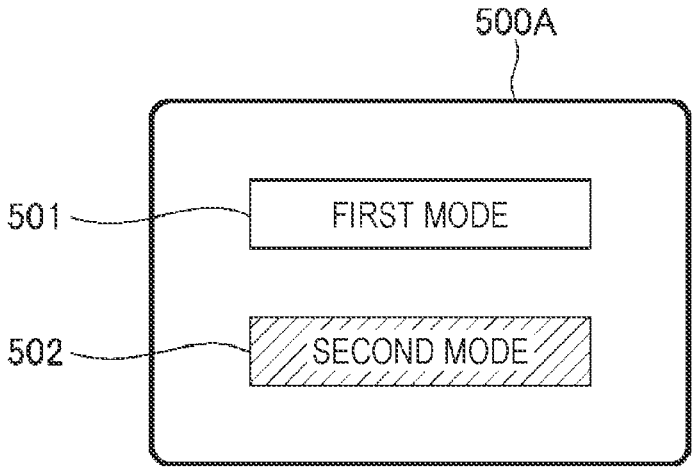
FIG. 10 is a diagram illustrating an example of a display screen displayed by the second embodiment of the fiber body forming apparatus of the present disclosure.
Figure 11:
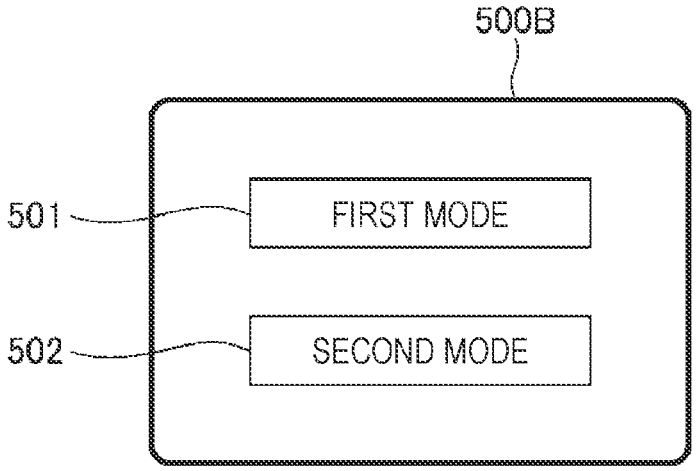
FIG. 11 is a diagram illustrating an example of the display screen displayed by the second embodiment of the fiber body forming apparatus of the present disclosure.

FIG. 9 is a flowchart for explaining an example of a control operation executed by a control unit included in the second embodiment of the fiber body forming apparatus of the present disclosure. FIGS. 10 and 11 illustrate examples of a display screen displayed by the second embodiment of the fiber body forming apparatus of the present disclosure.

Hereinafter, the second embodiment of the fiber body forming apparatus of the present disclosure and the control method of the fiber body forming apparatus of the present disclosure will be described with reference to these figures, but mainly differences from the first embodiment described earlier will be described, and description of similar matters will be omitted.

The present embodiment is similar to the first embodiment described above except for the control operation of the control unit. The control unit 28 executes steps S201 to S208. Step S201 is the same as step S101 described in the first embodiment, step S203 is the same as step S103 described in the first embodiment, step S204 is the same as step S104 described in the first embodiment, step S206 is the same as step S106 described in the first embodiment, step S207 is the same as step S107 described in the first embodiment, and step S208 is the same as step S108 described in the first embodiment.

In the present embodiment, in step S202, the control unit 28 displays a selection screen 500A illustrated in FIG. 10 on an input operation unit (not illustrated). In addition, the control unit 28 displays a selection screen 500B illustrated in FIG. 11 on an input operation unit (not illustrated).

On the selection screen 500A, a first mode selection button 501 for selecting the first mode and a second mode selection button 502 for selecting the second mode are displayed. On the selection screen 500A, only the first mode selection button 501 is valid, and the second mode selection button 502 is invalid. As a result, when the sheet substrate S1 is not loaded, the first mode can be inevitably selected. Note that display of the second mode selection button 502 may be omitted.

On the selection screen 500B, the first mode selection button 501 for selecting the first mode and the second mode selection button 502 for selecting the second mode are displayed. On the selection screen 500B, both the first mode selection button 501 and the second mode selection button 502 are valid. As a result, even when the sheet substrate S1 is loaded, the operator can select both the first mode and the second mode.

The input operation unit is configured by, for example, a touch panel monitor. The input operation unit is installed at any appropriate position outside the casing 50 illustrated in FIG. 2.

As described above, although the fiber body forming apparatus of the present disclosure and the control method of the fiber body forming apparatus have been described with respect to the illustrated embodiments, the present disclosure is not limited thereto, and each unit and step constituting the fiber body forming apparatus and the control method of the fiber body forming apparatus can be replaced with a unit and a step of any configuration capable of performing a similar function. Furthermore, any appropriate component and step may be added.

What is claimed is:

1. A fiber body forming apparatus comprising:

an accumulating unit that has a drum that releases a material containing a fiber, and an accumulating member which is a belt or a plate-like member, which is disposed vertically below the drum such that the drum and a part of the accumulating member face to each other in a vertical direction, and on which the material released from the drum accumulates;

a sheet substrate supply unit that is disposed upstream relative to the accumulating member in a supply direction of a sheet substrate and supplies the sheet substrate in an intersecting direction toward a position vertically below the drum, the intersecting direction intersecting the vertical direction; and a control unit that is electrically connected to the accumulating unit and the sheet substrate supply unit, and includes a processor that controls operation of the accumulating unit and the sheet substrate supply unit, the control unit being configured to selectively execute a first mode by controlling the accumulating unit to accumulate the material on the accumulating member and a second mode by controlling the sheet substrate supply unit to supply the sheet substrate in the intersecting direction toward the position vertically below the unit drum and by controlling the accumulating unit to accumulate the material on the sheet substrate.

2. The fiber body forming apparatus according to claim 1, wherein the sheet substrate supply unit includes a loading portion into which the sheet substrate is loaded and a detecting unit that detects whether or not the sheet substrate is loaded into the loading portion, and the control unit selects the first mode or the second mode according to a detection result of the detecting unit.

3. The fiber body forming apparatus according to claim 2, wherein when the detecting unit detects that the sheet substrate is loaded into the loading portion, the control unit selects the second mode and when the detecting unit does not detect that the sheet substrate is loaded into the loading portion, the control unit selects the first mode.

4. The fiber body forming apparatus according to claim 1, wherein the sheet substrate is wound, and in the second mode, the sheet substrate supply unit unrolls and supplies the sheet substrate wound into a roll.

5. The fiber body forming apparatus according to claim 1, wherein in the second mode, the sheet substrate supply unit supplies the sheet substrate on the accumulating member.

6. The fiber body forming apparatus according to claim 1, wherein the accumulating member is a mesh belt, and the accumulating unit has a suction unit that is provided on a side of a surface, of the mesh belt, opposite to a surface on which the material accumulates and that sucks the material through the mesh belt.

7. The fiber body forming apparatus according to claim 1, wherein the sheet substrate supply unit charges the sheet substrate immediately before the accumulating unit in a route through which the material is transported.

8. The fiber body forming apparatus according to claim 1, wherein the sheet substrate has an air permeable substrate layer containing a fiber and a function member carried on the substrate layer, and the function member is a magnetic body, a metal wire, a radio frequency tag, or an integrated circuit chip.

9. The fiber body forming apparatus according to claim 8, wherein the accumulating unit causes the material to accumulate so that the material covers the function member exposed on a surface of the sheet substrate.

10. A control method of a fiber body forming apparatus including an accumulating unit that has a drum that releases a material containing a fiber and an accumulating member which is a belt or a plate-like member, which is disposed vertically below the drum such that the drum and a part of the accumulating member face to each other in a vertical direction, and on which the material released from the drum accumulates; and a sheet substrate supply unit that is disposed upstream relative to the accumulating member in a supply direction of a sheet substrate and supplies the sheet substrate in an intersecting direction toward a position vertically below the drum, the intersecting direction intersecting the vertical direction, the control method comprising controlling operation of the accumulating unit and the sheet substrate supply unit to selectively execute a first mode by controlling the accumulating unit to accumulate the material on the accumulating member and a second mode by controlling the sheet substrate supply unit to supply the sheet substrate in the intersecting direction toward the position vertically below the drum and by controlling the accumulating unit to accumulate the material on the sheet substrate.

* * * * *